US010484799B1

(12) United States Patent
Ye

(10) Patent No.: US 10,484,799 B1
(45) Date of Patent: Nov. 19, 2019

(54) PHOTOELECTRIC MEMS MICROPHONE AND ELECTRONIC DEVICE

(71) Applicants: ZILLTEK TECHNOLOGY (SHANGHAI) CORP., Shanghai (CN); ZILLTEK TECHNOLOGY CORP., Hsinchu (TW)

(72) Inventor: Jinghua Ye, Shanghai (CN)

(73) Assignees: ZILLTEK TECHNOLOGY (SHANGHAI) CORP., Shanghai (CN); ZILLTEK TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 16/142,602

(22) Filed: Sep. 26, 2018

(30) Foreign Application Priority Data

Aug. 17, 2018 (CN) ..... 2018 1 0943428

(51) Int. Cl.

| | |
|---|---|
| ***H04R 19/04*** | (2006.01) |
| ***H04R 1/04*** | (2006.01) |
| ***H04R 3/00*** | (2006.01) |
| *H05B 33/08* | (2006.01) |

(52) U.S. Cl.
CPC ..... *H04R 19/04* (2013.01); *H04R 1/04* (2013.01); *H04R 3/00* (2013.01); *H04R 2201/003* (2013.01); *H05B 33/0845* (2013.01)

(58) Field of Classification Search
CPC . H04R 19/04; H04R 1/04; H04R 3/00; H04R 2201/003; H05B 33/0845
USPC ..... 381/58, 306, 333, 388, 91–92, 113
See application file for complete search history.

(56) References Cited

U.S. PATENT DOCUMENTS

| | | | | |
|---|---|---|---|---|
| 8,270,623 | B2 * | 9/2012 | Hamilton | H04R 29/008 381/58 |
| 2006/0177083 | A1 * | 8/2006 | Sjursen | H04R 19/016 381/322 |
| 2014/0177895 | A1 * | 6/2014 | Buisker | G09F 9/33 381/333 |
| 2015/0146883 | A1 * | 5/2015 | Palitsky | H04R 3/005 381/92 |
| 2016/0134973 | A1 * | 5/2016 | Oliaei | H04R 17/02 381/114 |
| 2018/0041841 | A1 * | 2/2018 | Zou | H04R 19/005 |
| 2018/0305200 | A1 * | 10/2018 | Goller | B81B 7/0058 |
| 2018/0352315 | A1 * | 12/2018 | Gelling | G06F 3/162 |

* cited by examiner

*Primary Examiner* — Disler Paul
(74) *Attorney, Agent, or Firm* — Levenfeld Pearlstein, LLC

(57) ABSTRACT

A photoelectric MEMS microphone and an electronic device, have an acoustic cavity, the acoustic cavity includes a MEMS transducer, configured for capturing an acoustic signal, a signal processing chip, connected to a signal output terminal of the MEMS transducer. The signal processing chip includes a signal output terminal pin and a ground pin, and a light emitting device, a driving terminal of the light emitting device being connected to the signal output terminal pin. The light emitting device packaged in the microphone cavity provides the user indication that the microphone of the terminal device is turned on, avoiding the exposure of personal privacy. Furthermore, it helps to reduce costs in that the signal output terminal pin and the ground pin are integrated into the microphone.

6 Claims, 1 Drawing Sheet

PHOTOELECTRIC MEMS MICROPHONE AND ELECTRONIC DEVICE

RELATED APPLICATION INFORMATION

This application claims the benefit of and priority to Chinese Patent Application No. 201810943428.8, filed Aug. 17, 2018, the disclosure of which is incorporated herein by reference.

BACKGROUND OF THE INVENTION

1. Field of the Invention

The invention relates to the technical field of MEMS (Micro Electro Mechanical System), and more particularly, to a photoelectric MEMS microphone and an electronic device.

2. Description of the Related Art

With the development of mobile multimedia technology, electronic devices tend to become miniature and integrated. Among the electronic products in the electronic acoustic field, a microphone is used to convert an acoustic signal into an electrical signal. In recent years, the microphone structure has been widely used in mobile phones, headphones, laptops, video cameras and other electronic devices.

For the microphone in the prior art, the transducer is used to convert an acoustic signal into an electrical signal first, and the circuit chip performs conversion processing on the electrical signal, and finally access for the electronic device is provided. In the prior art, the electronic device is not provided with a component serving to remind the user of the status of the microphone, that is, whether the microphone is turned on or turned off. As a result, the possibility is that personal privacy may be threatened in the public spaces in the case where the user does not realize that the microphone is on, resulting in inconvenience to the user.

SUMMARY OF THE INVENTION

Given that the foregoing problems exist in the prior art, the present invention provides a photoelectric MEMS microphone and an electronic device.

Detailed technical schemes are as follows:

A photoelectric MEMS microphone, having an acoustic cavity therein, is provided, wherein the acoustic cavity comprises:

a MEMS transducer, configured for capturing an acoustic signal;

a signal processing chip, connected to a signal output terminal of the MEMS transducer, wherein the signal processing chip comprises:

a signal output terminal pin; and a ground pin;

a light emitting device, a driving terminal of the light emitting device being connected to the signal output terminal pin.

Preferably, the light emitting device comprises an LED light.

Preferably, a brightness of the light emitting device is in direct proportion to an output signal of the signal processing chip.

Preferably, the photoelectric MEMS microphone comprises a voltage/current acquisition circuit, wherein an input terminal of the voltage/current acquisition circuit is connected to the signal output terminal pin for obtaining electric energy from the signal output terminal pin and storing the electric energy, and wherein an output terminal of the voltage/current acquisition circuit is configured for outputting the electric energy, so as to power the signal processing chip and the light emitting device, respectively.

Preferably, the photoelectric MEMS microphone further comprises a bias power supply, wherein an input terminal of the bias power supply is connected to the output terminal of the voltage/current acquisition circuit for receiving the electric energy output from the voltage/current acquisition circuit, and for outputting a working voltage from an output terminal of the bias power supply;

wherein a power supply terminal of the MEMS transducer is arranged between the output terminal of the bias power supply and the ground pin.

Preferably, the photoelectric MEMS microphone further comprises a metal housing and a substrate, wherein the substrate and the metal housing forms the acoustic cavity.

Preferably, the metal housing is provided with an acoustic through-hole;

and wherein the LED light has a size corresponding to a size of the acoustic through-hole.

Preferably, the substrate is a printed circuit board, and the printed circuit board is provided with a bonding pad at its bottom.

An electronic device, comprising any of the photoelectric MEMS microphones described above;

wherein the electronic device is provided with a plurality of photoelectric MEMS microphones, and the electronic device determines a direction from which a sound source comes, and illuminates the light emitting device of the MEMS microphone in the direction of the sound source.

The beneficial effects of the technical schemes of the invention include: a light emitting device is packaged in the microphone cavity, and the light emitting device is driven by the signal output terminal pin of the signal processing chip, and the brightness of the light emitting device indicates the intensity of the sound signal. In addition, the direction of the sound source of the MEMS microphone can be determined from the direction of the light source of the light emitting device. In this way, it may facilitate a user to get to know that the microphone of the terminal device is turned on, avoiding the exposure of personal privacy. Furthermore, it helps to further save the costs that the signal output terminal pin and the ground pin are integrated into the microphone in the prior art, and the signal output terminal pin is used for communication line and power supply line.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
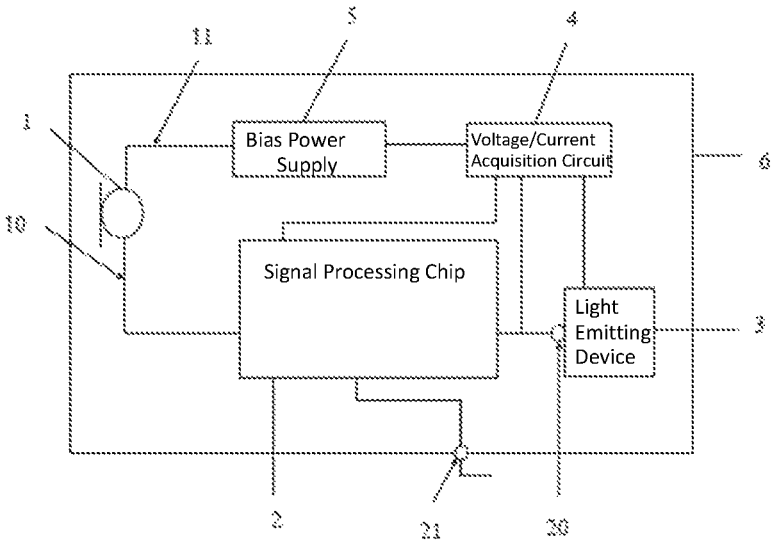
FIG. 1 is a circuit diagram of an optoelectronic MEMS microphone according to the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

The present invention comprises a photoelectric MEMS microphone, having an acoustic cavity therein, is provided, wherein the acoustic cavity comprises:

a MEMS transducer 1, configured for capturing an acoustic signal;

a signal processing chip 2, connected to a signal output terminal 10 of the MEMS transducer 1, wherein the signal processing chip 2 comprises:

a signal output terminal pin 20; and a ground pin 21;

a light emitting device 3, a driving terminal 30 of the light emitting device 3 being connected to the signal output terminal pin 20.

Figure 2:
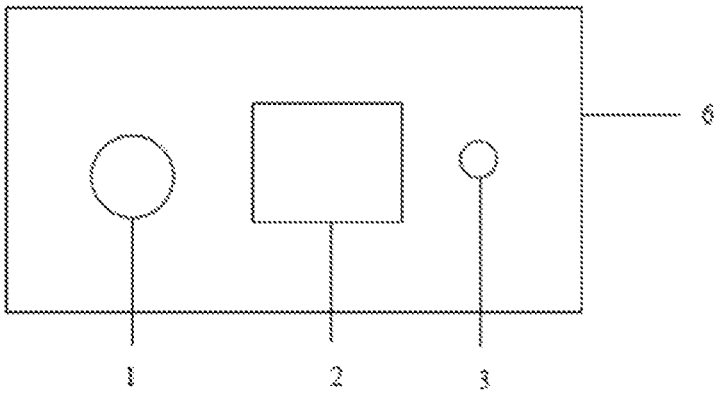
FIG. 2 is a top view of an optoelectronic MEMS microphone according to the present invention.

In the above-mentioned photoelectric MEMS microphone, as shown in FIGS. 1 and 2, a light-emitting device 3, a signal output terminal pin 20, and a ground pin 21 are incorporated into the microphone in the prior art, wherein the signal output terminal pin 20 is used for communication line and power supply line. In addition, the photoelectric MEMS microphone further comprises a MEMS transducer and a signal processing chip 2.

Specifically, the acoustic signal, captured by the MEMS transducer 1, is outputted to the signal processing chip 2 through the signal output terminal 10, the signal processing chip 2 then converges the acoustic signal into a current signal, and the light emitting device 3 is triggered by the signal output terminal pin 20, such that the light emitting device 3 adjusts the brightness based on the intensity of the current signal.

Furthermore, in accordance with an increase in the acoustic signal captured by the MEMS transducer 1, the acoustic signal received by the signal processing chip 2 is increased, and the intensity of the current signal converged from the acoustic signal by the signal processing chip 2 is increased then, and the current flowing through the light emitting device 3 is increased, and accordingly, the brightness of the light emitting device 3 is enhanced, that is to say, the brightness of the light emitting device 3 indicates the intensity of the acoustic signal. Moreover, when surrounded by people in the public places, the user may know whether the MEMS microphone is turned on or not according to the brightness of the light emitting device 3, and thus the user may further to know whether the microphone of the terminal device is turned on or not, avoiding the exposure of personal privacy.

Furthermore, a light emitting device is packaged in the microphone cavity, and the light emitting device is driven by the signal output terminal pin of the signal processing chip, and the brightness of the light emitting device indicates the intensity of the sound signal. In addition, the direction of the sound source of the MEMS microphone can be determined from the direction of the light source of the light emitting device. In this way, it may facilitate a user to get to know that the microphone of the terminal device is turned on, avoiding the exposure of personal privacy. Furthermore, integrating the signal output terminal pin and the ground pin into the microphone of the prior art, and the signal output terminal pin is used for communication line and power supply line, which helps to further save the costs.

In a preferred embodiment, the light emitting device 3 comprises an LED light.

Specifically, as shown in FIG. 2, the LED light is considered as the preferred embodiment of the light emitting device 3 for the illustration of the working principle of the MEMS microphone, however, it is to be understood that the light emitting device 3 is not limited to the LED light, which will not be repeated herein.

In a preferred embodiment, a brightness of the light emitting device 3 is in direct proportion to an output signal of the signal processing chip 2.

Specifically, the brightness of the light emitting device 3 is in direct proportion to the output signal of the signal processing chip 2, that is to say, in accordance with an increase in the acoustic signal captured by the MEMS transducer 1, the acoustic signal received by the signal processing chip 2 is increased, and the intensity of the current signal converged from the acoustic signal by the signal processing chip 2 is increased then, and the current flowing through the light emitting device 3 is increased, and accordingly, the brightness of the light emitting device 3 is enhanced, that is to say, the brightness of the light emitting device 3 indicates the intensity of the acoustic signal. Moreover, when surrounded by people in the public places, the user may know whether the MEMS microphone is turned on or not according to the brightness of the light emitting device 3, and thus the user may further to know whether the microphone of the terminal device is turned on or not, therefore, the exposure of personal privacy can be avoided, processing complexity involved in the manufacturing of the microphone may be simplified, and the utility rate and application of the electronic device may be increased.

In a preferred embodiment, the photoelectric MEMES microphone comprises a voltage/current acquisition circuit 4, wherein an input terminal of the voltage/current acquisition circuit 4 is connected to the signal output terminal pin 20 for obtaining electric energy from the signal output terminal pin 20 and storing the electric energy, and wherein an output terminal of the voltage/current acquisition circuit 4 is configured for outputting the electric energy, so as to power the signal processing chip 2 and the light emitting device 3, respectively.

The photoelectric MEMES microphone comprises a bias power supply 5, wherein an input terminal of the bias power supply 5 is connected to the output terminal of the voltage/current acquisition circuit 4 for receiving the electric energy output from the voltage/current acquisition circuit 4, and for outputting a working voltage from an output terminal of the bias power supply 5;

wherein a power supply terminal 11 of the MEMS transducer 1 is arranged between the output terminal of the bias power supply 5 and the ground pin 21.

Specifically, as shown in FIG. 1, the photoelectric MEMES microphone further comprises a voltage/current acquisition circuit 4 and a bias power supply 5, wherein the voltage/current acquisition circuit 4 is configured for receiving the electric energy output from the signal output terminal pin 20 and storing the obtained electric energy, and wherein the output terminal of the voltage/current acquisition circuit 4 is configured for outputting the electric energy to power the signal processing chip 2, the light emitting device 3 and the bias power supply, respectively. In addition, the voltage/current acquisition circuit 4 further comprises a voltage reduction unit (not shown in the figures), wherein the voltage reduction unit (not shown in the figures) is configured for reducing the voltage at the signal Output terminal pin 20 to the Output terminal of the voltage/current acquisition circuit 4;

furthermore, the input terminal of the bias power supply 5 is connected to the output terminal of the voltage/current acquisition circuit 4 for receiving the electric energy output from the voltage/current acquisition circuit 5, and for outputting a working voltage from the output terminal of the bias power supply 5, so as to output a bias voltage to power the MEMS transducer 1.

In a preferred embodiment, the photoelectric MEMS microphone further comprises a metal housing (not shown in the figures) and a substrate 6, wherein the substrate 6 and the metal housing (not shown in the figures) forms the acoustic cavity.

Specifically, since the metal housing (not shown in the figures) may have some protection from electromagnetic interference, and the metal housing (not shown in the figures) is well matched with the substrate 6, such that a good acoustic cavity can be formed, the metal housing (not shown in the figures) is selected as the housing of the photoelectric MEMS microphone. In the acoustic cavity, the signal processing chip 2 is an integral part of the photoelectric MEMS microphone, and the current signal is outputted through the signal output terminal pin 21 to trigger the light emitting device 3. Furthermore, the intensity of the sound signal can be implied from the brightness of the light emitting device, and the direction of the sound source of the MEMS microphone can be determined from the direction of the light source of the light emitting device. In this way, it may help the user to know that the microphone of the terminal device is turned on, therefore, the exposure of personal privacy can be avoided, processing complexity involved in the manufacturing of the microphone may be simplified, and the utility rate and application of the electronic device may be increased.

In a preferred embodiment, the metal housing (not shown in the figures) is provided with an acoustic through-hole;

and the LED light has a size corresponding to a size of the acoustic through-hole.

Specifically, the metal housing (not shown in the figures) is selected as the housing of the photoelectric MEMS microphone due to its advantage of having some protection from electromagnetic interference, and the metal housing (not shown in the figures) is provided with the acoustic through-hole, all of which defined above belong to one of the applications commonly used in the prior art. Therefore, details in this regard will not be repeated herein;

furthermore, the LED light has a size corresponding to a size of the acoustic through-hole. As a result, the light emitted from the LED light can be transmitted through the acoustic through-hole, and the intensity of the acoustic signal can be reflected by the brightness of the light emitting device 3; and in many public places, it can be determined whether the MEMS microphone is turned on or not according to the brightness of the light emitting device 3, and thus it may help the user to know the microphone of the terminal device is turned on, therefore, the exposure of personal privacy can be avoided, processing complexity involved in the manufacturing of the microphone may be simplified, and the utility rate and application of the electronic device may be increased.

In a preferred embodiment, the substrate 6 is a printed circuit board, and the printed circuit board is provided with a bonding pad (not shown in the figures) at its bottom.

Specifically, the printed circuit board here is adopted as the substrate 6, and the printed circuit board is provided with a bonding pad (not shown in the figures) at its bottom, and is well matched with the metal housing (not shown in the figures), such that an easily recognizable, high-fidelity voice signal can be received from the outside world.

An electronic device, comprising any of the photoelectric MEMS microphones described above;

wherein the electronic device is provided with a plurality of photoelectric MEMS microphones, and the electronic device determines a direction from which a sound source comes, and illuminates the light emitting device 3 of the MEMS microphone in the direction of the sound source.

Specifically, the photoelectric MEMS microphone may find an application in mobile phones, laptops and other electronic devices. By disposing the plurality of photoelectric MEMS microphones in the electronic device, the brightness of the light emitting device indicates the intensity of the sound signal. In addition, the direction of the sound source of the MEMS microphone can be determined from the direction of the light source of the light emitting device. In this way, it may help a user to get to know that the microphone of the terminal device is turned on, therefore, the exposure of personal privacy can be avoided, processing complexity involved in the manufacturing of the microphone may be simplified, and the utility rate and application of the electronic device may be increased.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A photoelectric MEMS microphone having an acoustic cavity, the photelectric MEMS microphone comprising:

a MEMS transducer configured for capturing an acoustic signal;

a signal processing chip connected to a signal output terminal of the MEMS transducer, wherein the signal processing chip comprises a signal output terminal pin, and a ground pin; and a light emitting device, a driving terminal of the light emitting device being connected to the signal output terminal pin;

wherein the MEMS transducer, the signal processing chip, the signal output terminal pin and light emitting device are disposed in the acoustic cavity, wherein the signal processing chip converges the acoustic signal into a current signal, and wherein the light emitting device is triggered by the signal output terminal pin, such that a brightness of the light emitting device is adjusted based on an intensity of the current signal, and wherein when the acoustic signal received by the signal processing chip is increased, and the intensity of the current signal converged from the acoustic signal by the signal processing chip is increased by an increase in the acoustic signal captured by the MEMS transducer, a current flow through the light emitting device is increased, enhancing the brightness of the light emitting device to provide an indication of an intensity of the acoustic signal, wherein the light emitting device is an LED light, and further comprising a metal housing and a substrate, wherein the substrate and the metal housing form the acoustic cavity, wherein the metal housing is provided with an acoustic through-hole, and wherein the LED light has a size corresponding to a size of the acoustic through-hole.

2. The photoelectric MEMS microphone as claimed in claim 1, wherein the brightness of the light emitting device is in direct proportion to an output signal of the signal processing chip.

3. The photoelectric MEMS microphone as claimed in claim 1, wherein the substrate is a printed circuit board, and the printed circuit board is provided with a bonding pad at its bottom.

4. An electronic device, comprising;

a photoelectric MEMS microphone having an acoustic cavity, the photoelectric MEMS microphone comprising:

a MEMS transducer configured for capturing an acoustic signal;

a signal processing chip connected to a signal output terminal of the MEMS transducer, the signal processing chip comprising a signal output terminal pin, and a ground pin; and a light emitting device, a driving terminal of the light emitting device being connected to the signal output terminal pin; and wherein a plurality of photoelectric MEMS microphones are configured within the electronic device, and the electronic device determines a direction from which a sound source comes, and illuminates the light emitting device of the MEMS microphone in the direction of the sound source, wherein the MEMS transducer, the signal processing chip, the signal output terminal pin and the light emitting device are disposed in the acoustic cavity, wherein the signal processing chip converges the acoustic signal into a current signal, and wherein the light emitting device is triggered by the signal output terminal pin, such that a brightness of the light emitting device is adjusted based on an intensity of the current signal, and wherein when the acoustic signal received by the signal processing chip is increased, and the intensity of the current signal converged from the acoustic signal by the signal processing chip is increased by an increase in the acoustic signal captured by the MEMS transducer, a current flow through the light emitting device is increased, enhancing the brightness of the light emitting device to provide an indication of an intensity of the acoustic signal, wherein the light emitting device is an LED light, wherein the photoelectric MEMS microphone further comprises a metal housing and a substrate, wherein the substrate and the metal housing form the acoustic cavity, wherein the metal housing is provided with an acoustic through-hole, and wherein the LED light has a size corresponding to a size of the acoustic through-hole.

5. The electronic device as claimed in claim 4, wherein the brightness of the light emitting device is in direct proportion to an output signal of the signal processing chip.

6. The electronic device as claimed in claim 4, wherein the substrate is a printed circuit board, and the printed circuit board is provided with a bonding pad at its bottom.

* * * * *